US006717077B1

(12) United States Patent
Chevarie et al.

(10) Patent No.: US 6,717,077 B1
(45) Date of Patent: Apr. 6, 2004

(54) SAFETY ELECTRICAL OUTLET

(75) Inventors: Albert Chevarie, Notre-Dame-de-I'Ile-Perrot (CA); Charles Fragapane, Lachine (CA)

(73) Assignee: 9037-8506 Quebec Inc., Lachine (CA)

( * ) Notice: Subject to any disclaimer, the term of this patent is extended or adjusted under 35 U.S.C. 154(b) by 0 days.

(21) Appl. No.: 10/615,290

(22) Filed: Jul. 9, 2003

(30) Foreign Application Priority Data

Jul. 10, 2002 (CA) ..... 2391092

(51) Int. Cl.[7] ..... H01R 33/96
(52) U.S. Cl. ..... 200/51.09; 439/188
(58) Field of Search ..... 200/51 R, 51.02, 200/51.09, 51.1, 51.12, 51.13; 439/188

(56) References Cited

U.S. PATENT DOCUMENTS

| | | | | | |
|---|---|---|---|---|---|
| 2,770,786 | A | | 11/1956 | Czyzewski | 339/40 |
| 2,898,413 | A | | 8/1959 | Gallagher | 200/42 |
| 4,072,382 | A | | 2/1978 | Reschke | 339/40 |
| 5,113,045 | A | | 5/1992 | Crofton | 200/51.09 |
| 5,320,545 | A | * | 6/1994 | Brothers | 439/188 |
| 5,865,635 | A | * | 2/1999 | Hsiang et al. | 439/188 |
| 6,111,210 | A | | 8/2000 | Allison | 200/51.09 |
| 6,183,264 | B1 | | 2/2001 | Harsanyi | 438/38 |
| 6,283,776 | B1 | * | 9/2001 | Gressly et al. | 439/188 |
| 6,455,789 | B1 | * | 9/2002 | Allison | 200/51.09 |
| 6,533,593 | B1 | * | 3/2003 | Ishii | 439/188 |

* cited by examiner

*Primary Examiner*—Michael A. Friedhofer
(74) *Attorney, Agent, or Firm*—Robic; Gonzalo Lavin

(57) ABSTRACT

A safety electrical outlet for receiving metallic prongs of an electrical plug. The outlet has a housing with at least two plug passages being sized for receiving the metallic prongs of the electrical plug, and two metallic connectors mounted on the housing for connection to an electrical power source. At least two transverse channels communicate with the corresponding plug passages and extend toward the corresponding metallic connectors with at least two spring-biased members being inserted in each corresponding transverse channel and being movable between an extended position where the spring-biased member partially extends within the corresponding plug passage and a retracted position where the corresponding metallic prong that is inserted inside the passage pushes against the spring-biased member so that it touches the corresponding metallic connector for establishing an electrical contact between the metallic prong and the corresponding metallic connector.

6 Claims, 4 Drawing Sheets

SAFETY ELECTRICAL OUTLET

FIELD OF THE INVENTION

The present invention relates to a safety electrical outlet, and more particularly to a safety electrical outlet that can prevent children from becoming shocked or electrocuted by inserting metallic objects therein.

BACKGROUND OF THE INVENTION

It is a well known fact that children have become shocked by inserting metallic objects, such as nails, utensils, small pliers or the like, into electrical outlets, particularly those that are located near the floor. This potential danger has been taken care of in different forms. One solution is to insert a plastic cover with two plastic prongs into the outlet, thereby preventing a child from touching or inserting objects into the openings of the outlet. However, when an adult uses the outlet, he or she has to remove the plastic cover, which is generally cumbersome, and remember to plug it back in. Furthermore, it is still possible that older children may be able to remove the plastic plug and insert objects into the outlet.

Known in the art, there are the following U.S. Pat. No. 2,770,786 (CHELTON); U.S. Pat. No. 2,898,413 (GALLAGHER): U.S. Pat. No. 4,072,382 (RESCHKE); U.S. Pat. No. 5,113,045 (CROFTON); U.S. Pat. No. 6,183, 264 (HARSANYI); and U.S. Pat. No. 6,111,210 (ALLISON), which disclose different safety outlets. However, such devices typically use several components and are therefore expensive or complicated to manufacture.

There is therefore a need for a safety electrical outlet that would be simple and relatively inexpensive to manufacture compared to the safety outlets known in the art.

SUMMARY OF THE INVENTION

An object of the invention is to provide a safety electrical outlet that can satisfy the above mentioned need and thus that is relatively simple and inexpensive to manufacture.

According to the present invention, there is provided a safety electrical outlet for receiving metallic prongs of an electrical plug, comprising:

- a housing having at least two plug passages being sized for receiving the metallic prongs of the electrical plug;
- at least two metallic connectors mounted on the housing for connection to an electrical power source;
- at least two transverse channels, each channel having an opening communicating with the corresponding plug passage and extending toward the corresponding metallic connector; and
- at least two spring-biased members having a top end and a bottom end, each spring-biased member being inserted in each corresponding transverse channel and being movable between an extended position where the first end of the spring-biased member partially extends within the corresponding plug passage and the second end is spaced apart from the metallic connector and a retracted position where the corresponding metallic prong that is inserted inside the passage pushes against the top end of the spring-biased member so that the second and of the spring-biased member touches the corresponding metallic connector for establishing an electrical contact between the metallic prong and the corresponding metallic connector.

The invention, its use and its advantages will be better understood upon reading of the following non-restrictive description of preferred embodiments thereof, made with reference to the accompanying drawings, in which like numbers refer to like elements.

DETAILED DESCRIPTION OF THE INVENTION

Figure 1:
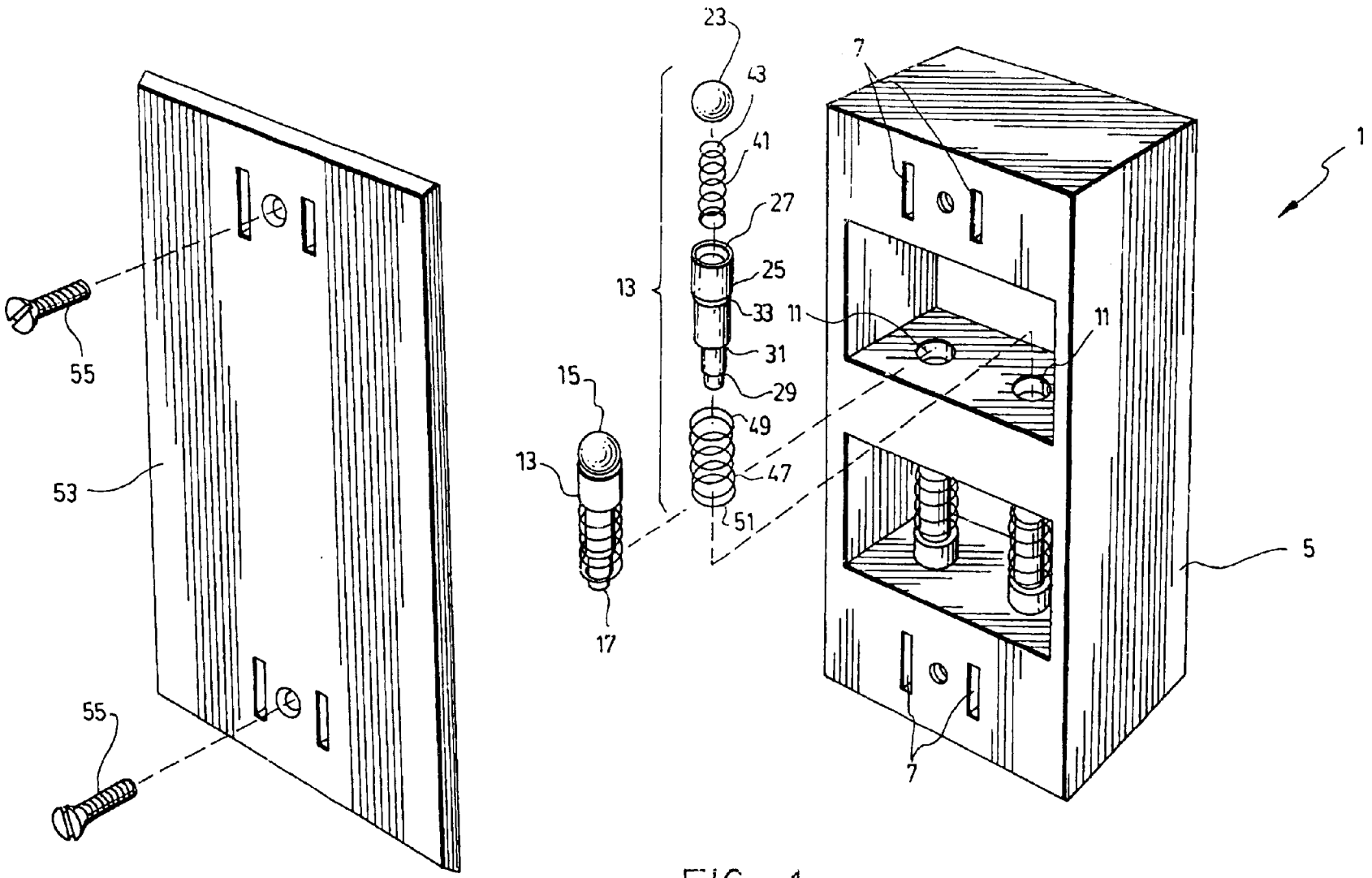
FIG. 1 is a perspective partially exploded view of a safety electrical outlet according to a preferred embodiment of the present invention.
Figure 2:
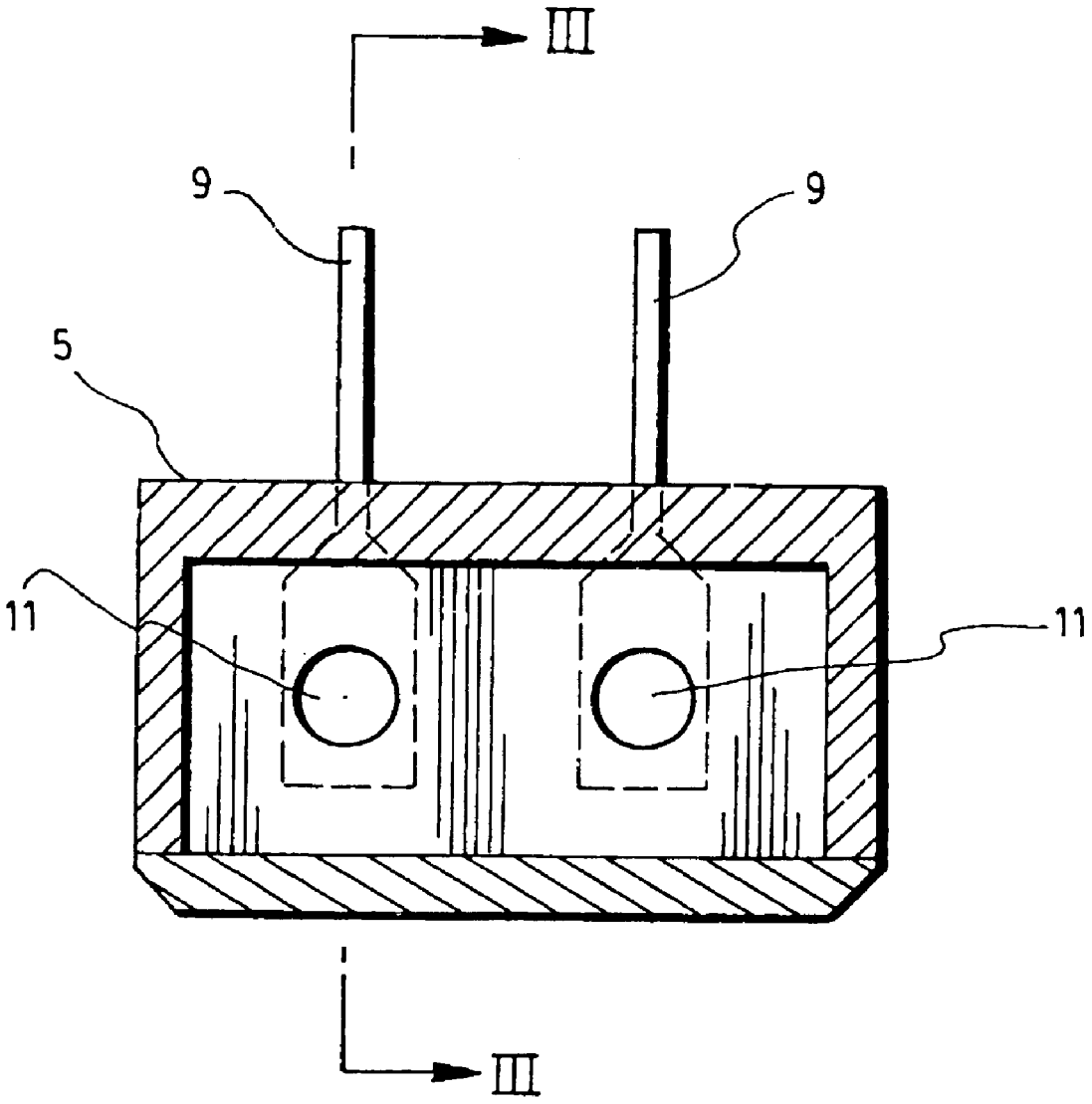
FIG. 2 is a section view of the safety electrical outlet shown in FIG. 1, taken along lines II—II of FIG. 3.
Figure 4:
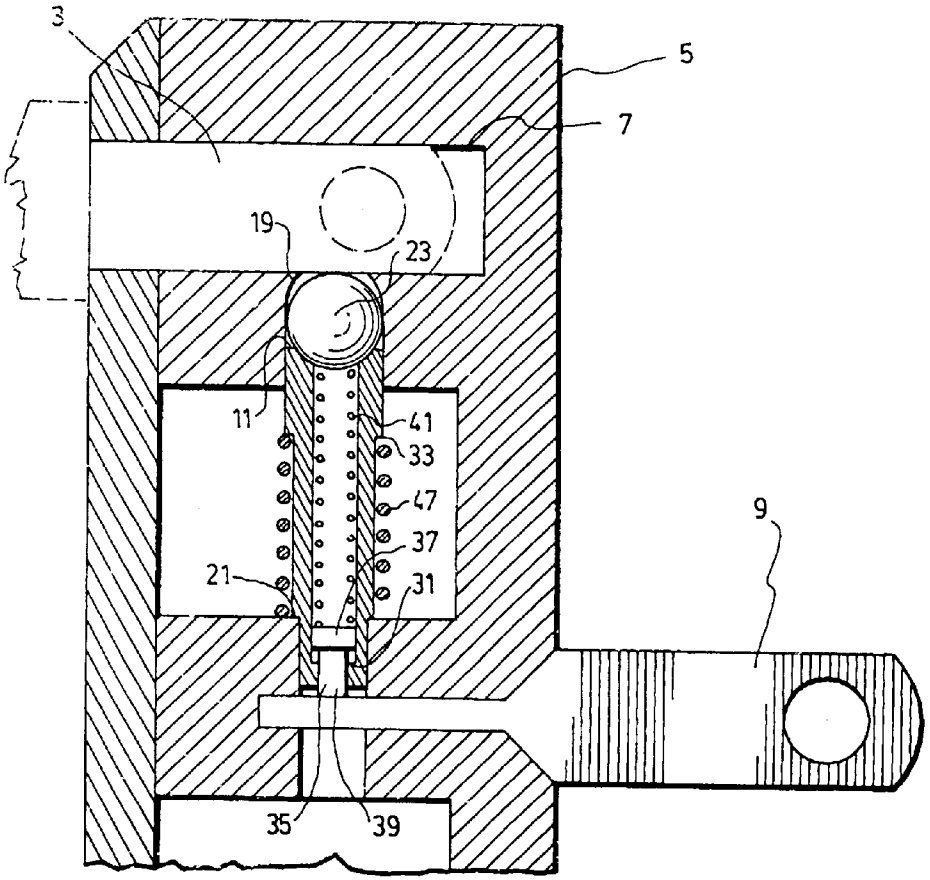
FIG. 4 is a partial cross section view of the safety electrical outlet shown in FIG. 2 along lines III—III, with internal elements being shown in a second position.

Referring to FIGS. 1 to 5, there is shown a safety electrical outlet 1 according to a preferred embodiment of the present invention for receiving the metallic prongs 3 of an electrical plug, as shown with dotted lines in FIG. 4. The outlet 1 includes a housing 5 with at least two plug passages 7 that are sized for receiving the metallic prongs 3 of the electrical plug. As best shown in FIG. 2, the outlet 1 includes at least two metallic connectors 9 mounted on the housing 5 for connection to an electrical power source. The outlet 1 also includes at least two transverse channels 11. Each channel 11 has an opening 12 communicating with the corresponding plug passage 7 and extends toward the corresponding metallic connector 9. Furthermore, the outlet 1 includes at least two spring-biased members 13 having a top end 15 and a bottom end 17, which are shown in FIG. 1. Each spring-biased member 13 is inserted in each corresponding transverse channel 11 and is movable between an extended position where the first end 15 of the spring-biased member 13 partially extends within the corresponding plug passage 7 and the second end 17 is spaced apart from the metallic connector 9, as shown for example in FIG. 3, and a retracted position where the corresponding metallic prong 3 that is inserted inside the passage 7 pushes against the top end 15 of the spring-biased member 13 so that the second end 17 of the spring-biased member 13 touches the corresponding metallic connector 9 for establishing an electrical contact between the metallic prong 3 and the corresponding metallic connector 9, as shown for example in FIG. 4.

The channels 11 are preferably located toward the back of the plug passage so that the plug is energized only when the plug is fully inserted into the outlet. Preferably, each channel 11 extends perpendicularly with respect to the corresponding plug passage 7.

Figure 3:
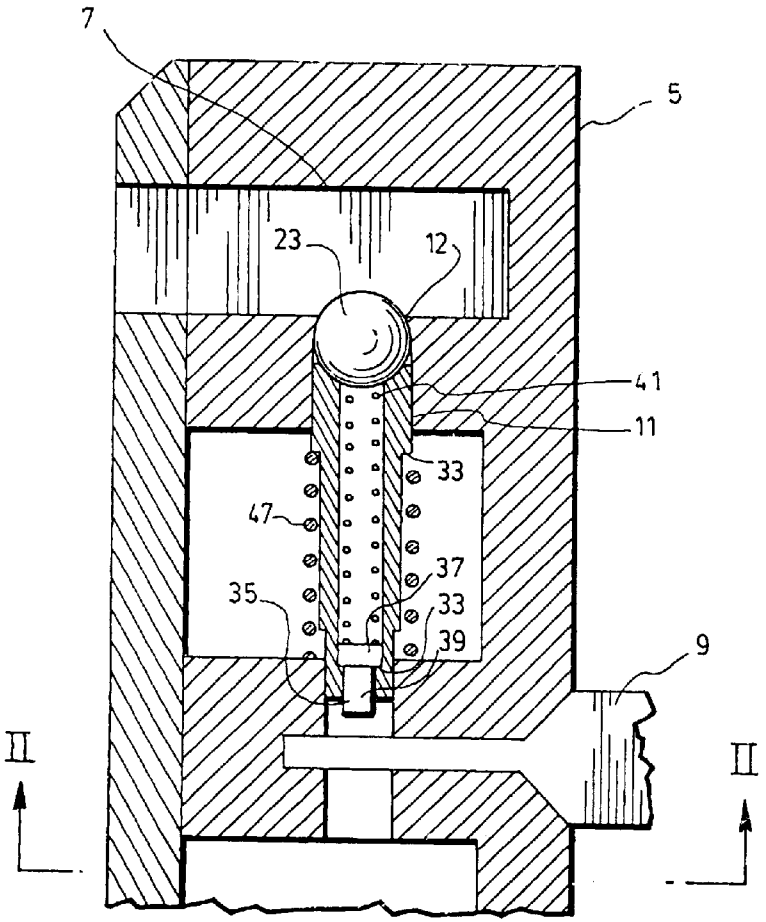
FIG. 3 is a partial cross section view of the safety electrical outlet shown in FIG. 2 along lines III—III, with internal elements being shown in a first position.

Preferably, each channel 11 has first and second abutment portions 19, 21 spaced apart from each other for receiving each spring-biased member 13, as shown for example in FIG. 4. Each spring-biased member 13 may include a metal ball 23 for abutting against the first abutment potion 19 of the channel 11. The metal ball 23 comes into contact with the metallic prong 3 when it is inserted in the plug passage 7, as shown in FIG. 4. The spring-biased member 13 also has a hollow rod 25 with first and second openings 27, 29, and inner and outer abutment portions 31,33, which are best shown in FIG. 1. The metal ball 23 abuts against the first opening 27 of the hollow rod 25. A metal pin 35 is inserted inside the rod 25, as shown in FIGS. 3 and 4. The pin 35 has an enlarged head portion 37 for abutting against the inner abutment 31 of the rod 25 and a tip portion 39 sized to extend through the second opening 29 of the rod 25. The tip portion 39 makes contact with the metallic connector 9 when the metallic prong 3 is inserted in the plug passage 7, as shown in FIG. 4. An inner spring 41 is inserted inside the hollow rod 25. The inner spring 41 has a first end 43 for contacting the ball 23 and a second end 45 for contacting the head portion 37 of the pin 35 An outer spring 47 is coiled around the rod 25. The outer spring 47 has a first end 49 for abutting against the outer abutment portion 33 of the rod 25 and a second end 51 for abutting against the second abutment portion 21 of the channel 11.

It should be noted that the spring-member may take many different shapes and forms. For example, the metallic ball may be replaced by a rounded cap which is mounted on a spring loaded rod. Several other functional equivalents may be conceived as those skilled in the art will understand.

Preferably, as shown in FIG. 1 and 2, the outlet 1 has a cover 53 connected to the front face of the housing 5 via screws 55 and the metallic connectors 9 are located on the back face of the housing 5.

Figure 5:
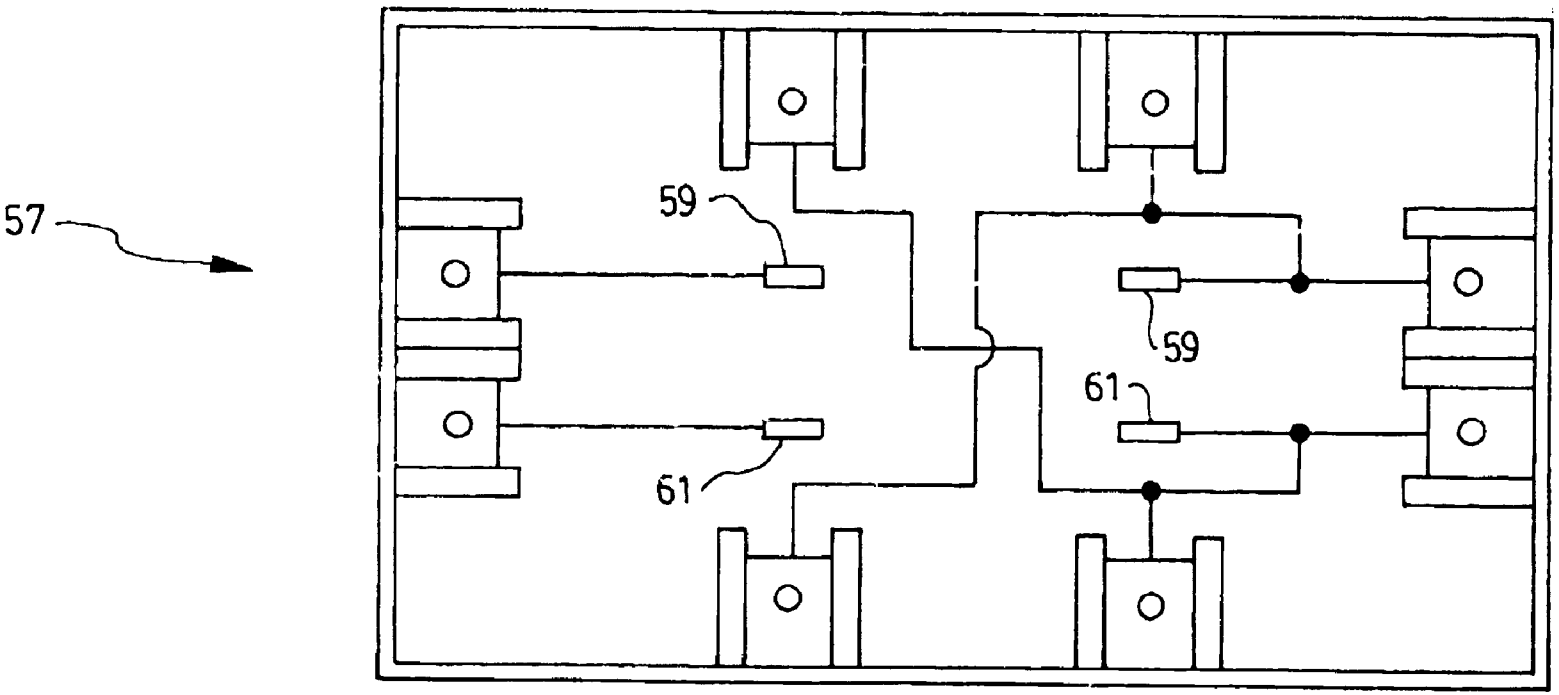
FIG. 5 is top view of an connector circuit according to a preferred embodiment of the present invention for connecting the safety electrical outlet shown in FIG. 1.

Preferably, referring to FIG. 5, the electric power source includes a connector circuit 57 having at least two passages 59, 61 for receiving the metallic connectors 9 of the housing 5. Those skilled in the art will understand that other configurations than those illustrated may be used for the same purpose to achieve the same result of energizing the metallic connectors 9. The metallic connectors are preferably plugged and unplugged to the power source, but it is also possible to provide for a permanent connection.

Preferably, as shown in FIG. 1, the outlet 5 has four plug passages 7, four corresponding transverse channels 11 and four spring-biased members 13. Of course, the number of plug passages and other components may vary as those skilled in the art will understand.

The outlet 1 according to a preferred embodiment of the present invention may be used as a 15 ampere, 125 AC, grounded duplex outlet. Of course, the principle of operation of the present invention may be applied in other types of outlets with different specifications.

The present invention protects against insertion of foreign metallic objects, such as nails, pins or the like. If the channels 11 are located sufficiently towards the back of the plug passages 7, then the outlet also protects against someone touching the side of the prongs which are partially inserted in the plug passages 7.

While embodiments of this invention have been illustrated in the accompanying drawings and described above, it will be evident to those skilled in the art that changes and modifications may be made therein without departing from the essence of this invention. All such modifications or variations are believed to be within the scope of the invention as defined by the claims appended hereto.

What is claimed is:

1. A safety electrical outlet for receiving metallic prongs of an electrical plug, comprising:

a housing having at least two plug passages being sized for receiving the metallic prongs of the electrical plug;

at least two metallic connectors mounted on the housing for connection to an electrical power source;

at least two transverse channels, each channel having an opening communicating with the corresponding plug passage and extending toward the corresponding metallic connector; and at least two spring-biased members having a top end and a bottom end, each spring-biased member being inserted in each corresponding transverse channel and being movable between an extended position where the first end of each of the spring-biased members partially extends within the corresponding plug passage and the second end is spaced apart from the corresponding metallic connector and a retracted position where the corresponding metallic prong that is inserted inside the corresponding passage pushes against the top end of the corresponding spring-biased member so that the second end of the corresponding spring-biased member touches the corresponding metallic connector for establishing an electrical contact between the corresponding metallic prong and the corresponding metallic connector.

2. The safety electrical outlet according to claim 1, wherein each channel has a first and second abutment portions spaced apart from each other for receiving each spring-biased member and wherein each spring-biased member comprises:

a metal ball for abutting against the first abutment potion of the channel;

a hollow rod having first and second openings and inner and outer abutment portions, the metal ball abutting against the first opening of the hollow rod;

a metal pin inserted inside the rod, the pin having an enlarged head portion for abutting against the inner abutment of the rod and a tip portion sized to extend through the second opening of the rod;

an inner spring inserted inside the hollow rod, the inner spring having a first end for contacting the ball and a second end for contacting the head portion of the pin; and an outer spring coiled around the rod, the outer spring having a first end for abutting against the outer abutment portion of the rod and a second end for abutting against the second abutment portion of the channel.

3. The safety electrical outlet according to claim 1, wherein each transverse channel extends perpendicularly with respect to the corresponding plug passage and is located on a rear part thereof.

4. The safety electrical outlet according to claim 1, wherein the housing has a front face and a back face, and wherein the outlet comprises a cover connected to the front face of the housing and the metallic connectors are located on the back face of the housing.

5. The safety electrical outlet according to claim 1, wherein the electric power source comprises a connector circuit having at least two passages for receiving the metallic connectors.

6. The safety electrical outlet according to claim 1, comprising four plug passages, four corresponding transverse channels and four spring-biased members.

* * * * *